US007834535B2

(12) United States Patent
Ibuki et al.

(10) Patent No.: US 7,834,535 B2
(45) Date of Patent: Nov. 16, 2010

(54) FLAT PANEL TYPE DISPLAY APPARATUS

(75) Inventors: Hiroaki Ibuki, Sagamihara (JP); Masahiro Yokota, Fukaya (JP); Keiji Suzuki, Yokohama (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 475 days.

(21) Appl. No.: 11/961,691

(22) Filed: Dec. 20, 2007

(65) Prior Publication Data

US 2008/0174230 A1 Jul. 24, 2008

(30) Foreign Application Priority Data

Dec. 25, 2006 (JP) ..... 2006-347643
Dec. 17, 2007 (JP) ..... 2007-324838

(51) Int. Cl.
*H01J 1/62* (2006.01)

(52) U.S. Cl. ..... 313/496; 313/495

(58) Field of Classification Search ..... 313/309–311, 313/495–497

See application file for complete search history.

(56) References Cited

U.S. PATENT DOCUMENTS 5,592,056 A * 1/1997 Peyre et al. ..... 315/169.1
6,426,596 B1 7/2002 Yamamoto et al. ..... 315/169.1
6,677,706 B1 1/2004 Hara et al. ..... 313/496
2002/0039007 A1 4/2002 Yamamoto et al. ..... 315/160
2003/0164675 A1 * 9/2003 Ando ..... 313/495
2005/0276096 A1 12/2005 Hara et al. ..... 365/158
2008/0111467 A1 5/2008 Yokota et al. ..... 313/495

FOREIGN PATENT DOCUMENTS

EP 1 786 018 A1 5/2007
JP 10-326583 12/1998
JP 2000-311642 11/2000
JP 2006-73248 3/2006

* cited by examiner

*Primary Examiner*—Bumsuk Won
(74) *Attorney, Agent, or Firm*—Fitzpatrick, Cella, Harper & Scinto

(57) ABSTRACT

A flat panel type display apparatus, which includes: a front substrate having a plurality of phosphor layers, an anode covering at least the plurality of phosphor layers, an electrode for applying a voltage to the anode, and a resistor member connecting the anode to the electrode; and a rear substrate having a plurality of electron-emitting devices corresponding to the plurality of phosphor layers, is characterized by including an insulating layer, and in that the insulating layer overlaps with the resistor member in an area, and isolates the anode formed in the area from the resistor member.

3 Claims, 5 Drawing Sheets

FLAT PANEL TYPE DISPLAY APPARATUS

BACKGROUND OF THE INVENTION

1. Field of the Invention

The present invention relates to a flat panel type display apparatus adapted to display an image in such a manner that electrons are made to be emitted from electron-emitting devices provided in a rear substrate, and phosphor layers provided in a front substrate is excited by the electrons to emit light.

2. Description of the Related Art

In recent years, a field emission display (FED), a display apparatus including surface conduction type electron-emitting devices, and the like, have been known as flat panel type display apparatuses having a vacuum envelope of a flat panel structure.

The FED and the display apparatus including surface conduction type electron-emitting devices have a vacuum envelope in which peripheral portions of front and rear substrates arranged opposite to each other at a predetermined interval via spacers are joined by a rectangular frame-like side wall, and the inside of which is evacuated.

Phosphor layers of three colors and a metal back covering the phosphor layers are formed over the inner surface of the front substrate. On the inner surface of the rear substrate, a number of electron-emitting devices as electron emission sources to make the phosphor layer excited and emit light, are arranged in correspondence with each pixel of the phosphor layer. Further, a getter film is formed over the inner surface of the front substrate in order to maintain a high vacuum inside the vacuum envelope.

A voltage higher by several kilovolts than the voltage of the electron-emitting device is applied to the metal back and the getter film, so that an electron beam emitted from the each electron-emitting device is accelerated by the electric field. Then, the accelerated electron beam passes through the metal back and the getter film, so as to be irradiated to the corresponding phosphor layer. Thereby, the phosphor is excited and emits light so as to display a color picture.

In this way, when the high voltage for accelerating the electron beam is applied between the front substrate and the rear substrate which are close to each other, a problem of discharge often arises. When the discharge is caused, a large current flows through the discharge place, so as to result in a problem that the electron-emitting device is damaged in the discharge place.

As a method for solving the problem, there is known a technique to reduce the discharge damage by such a way that the metal back covering the phosphor layer of the front substrate is electrically divided into small regions, and the resistance between the divided regions is made high, so that the current flowing at the time of the discharge is limited to reduce the discharge damage (see Japanese Patent Application Laid-Open No. H10-326583 and Japanese Patent Application Laid-Open No. 2000-311642). Further, there is known a technique adapted to divide the metal back layer and the getter layer, which are formed by vapor deposition, by reversely tapered ribs having the upper surface wider than the lower surface, in order to stabilize the resistance value between the divided regions of the metal back (see Japanese Patent Application Laid-Open No. 2006-073248). Further, there is disclosed a form in Japanese Patent Application Laid-Open No. H10-326583 and Japanese Patent Application Laid-Open No. 2000-311642, in which an anode is connected to an electrode via a resistor.

The present inventors have been investigating a structure for supplying an anode voltage to the anode via a resistor member from the electrode. Further, the present inventors have specifically investigated a structure in which the resistor member at least partially overlaps with the anode. As a result of the investigation, the present inventors have found a phenomenon that the resistance value between the electrode and the anode depends on the size of the anode forming region. The resistor member is used to prevent the state where the anode and the electrode is electrically connected to each other in a low resistance state. However, when the overlap between the resistor member and the anode is large, a desired resistance can be no longer obtained. An object of the present invention is to provide a display apparatus capable of realizing a suitable resistance state in the structure in which the anode and the electrode are connected to each other via a resistor member. One of specific examples resulting from the object will be described below.

An electroconductive layer which functions as an anode such as a metal back or a getter, may be formed in an image display area. Thus, it is possible restrict the film forming range of the electroconductive layer to the image display area by providing a guide at the time when an electroconductive material is irradiated, or by irradiating the electroconductive material in a box. However, structures on a substrate are damaged when the guide and the box are brought into contact with the substrate. Thus, it is preferred that the guide and the box are disposed at a distance from the substrate. However, when the electroconductive material is irradiated in the state where the guide and the box are disposed in this way, an electroconductive layer is also formed outside the image display area by the electroconductive material irradiated through a gap between the guide and the substrate, or through a gap between the box and the substrate.

In the periphery of the electroconductive layer formed in the image display area of the front substrate, a common electrode is annularly provided so as to surround the periphery of the electroconductive layer. The electroconductive layer and the common electrode are connected via a plurality of connecting resistors. The connecting resistor has a function to suppress a current which when an abnormal discharge is caused in the image display area, flows into the electroconductive layer from the common electrode for supplying electric power to the electroconductive layer in a high voltage.

However, when the electroconductive layer is formed outside the image display area as described above, the electroconductive layer is also formed on the connecting resistor, so that the length of the portion which functions as the connecting resistor is shortened to reduce the resistance value between the common electrode and the electroconductive layer. As a result, the connecting resistor is unable to suppress the current flowing into the electroconductive layer from the common electrode at the time when the abnormal discharge occurs in the image display area. The edge position of the region forming the electroconductive layer cannot be strictly fixed due to the characteristic of the electroconductive layer forming process as described above. Therefore, the resistance value between the common electrode and the electroconductive layer is made different depending on the forming region of the electroconductive layer on the connecting resistor.

SUMMARY OF THE INVENTION

A flat panel type display apparatus according to the present invention, which includes: a front substrate having a plurality of phosphor layers, an anode covering at least the plurality of phosphor layers, an electrode for applying a voltage to the anode, and a resistor member connecting the anode to the electrode; and a rear substrate having a plurality of electron-emitting devices corresponding to the plurality of phosphor layers, is characterized by including an insulating layer, and in that the insulating layer overlaps with the resistor member in an area, and isolates the anode formed in the area from the resistor member.

According to the present invention, it is possible to realize a flat panel type display apparatus in which the resistance value between the anode and the electrode for supplying a voltage to the anode is determined with sufficient accuracy.

Further features of the present invention will become apparent from the following description of exemplary embodiments with reference to the attached drawings.

BRIEF DESCRIPTION OF THE DRAWINGS

FIG. 6A is a sectional view of a portion corresponding to the sectional view taken along line A-A in FIG. 4.

FIG. 6B is a sectional view of a portion corresponding to the sectional view taken along line B-B in FIG. 4.

DESCRIPTION OF THE EMBODIMENTS

In the following, embodiments according to the present invention will be described with reference to the accompanying drawings.

First, a display apparatus including a surface conduction type electron-emitting devices will be described as an example of a flat panel type display apparatus according to an embodiment of the present invention.

Figure 1:
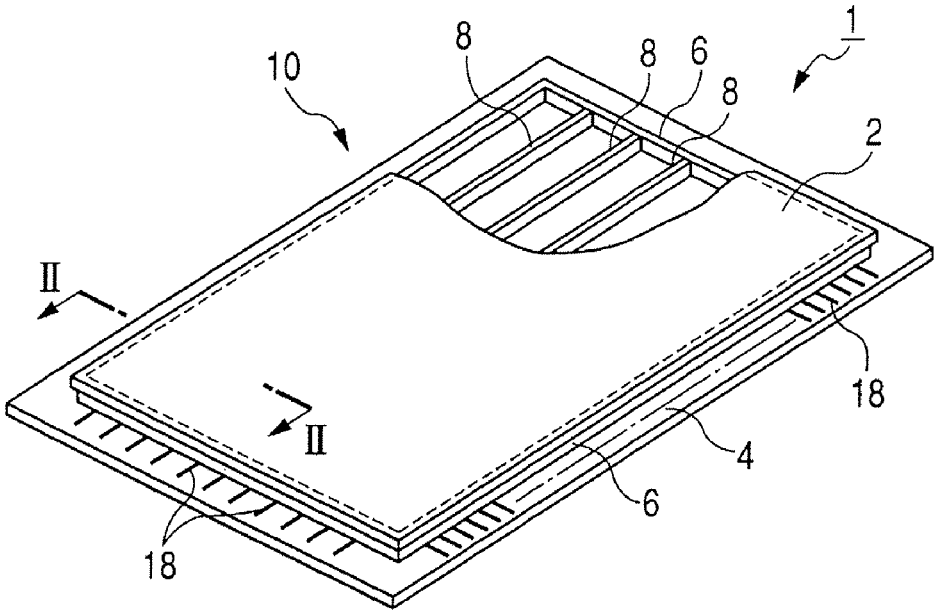
FIG. 1 is a perspective view showing a vacuum envelope of an SED in a state where a front substrate is partially cut away.
Figure 2:
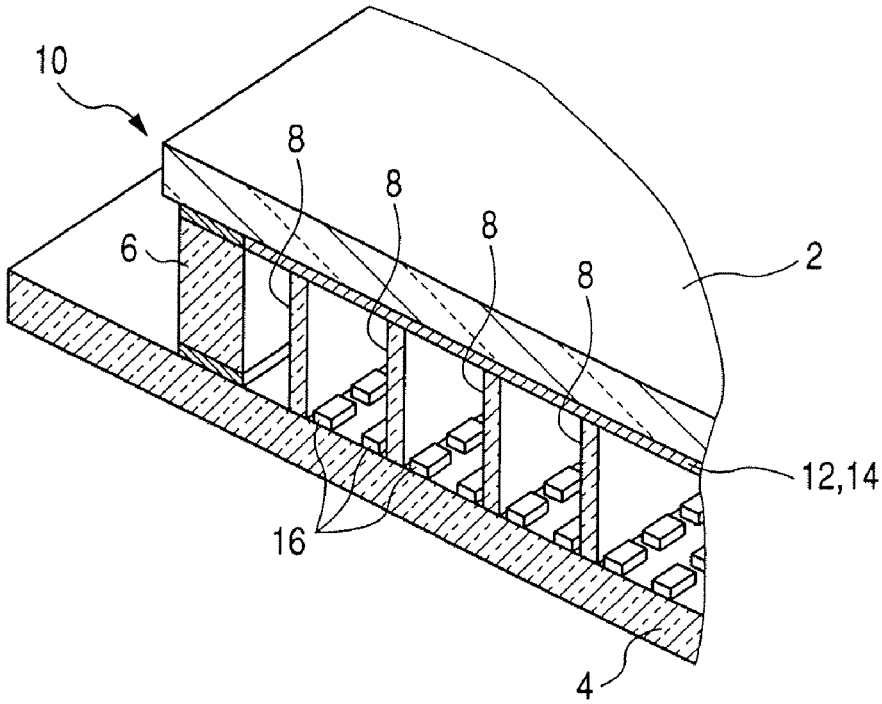
FIG. 2 is a sectional view of the vacuum envelope taken along line II-II shown in FIG. 1.
Figure 3:
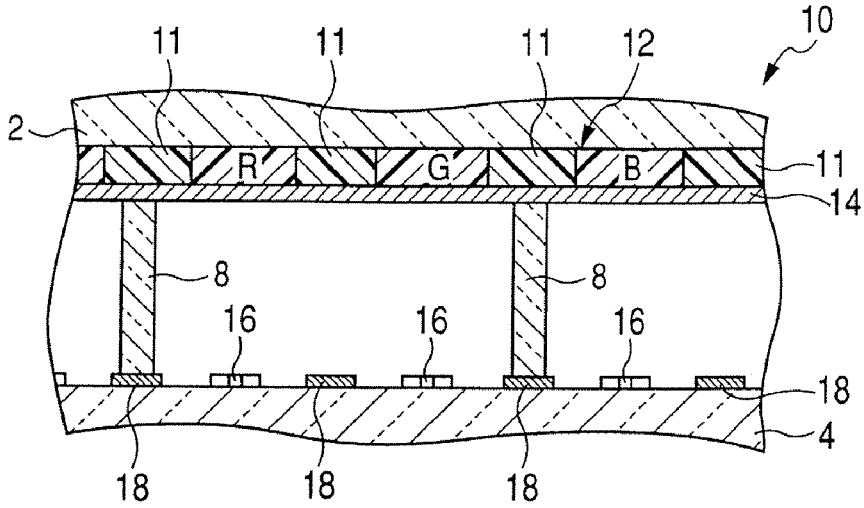
FIG. 3 is a partially enlarged sectional view of the sectional view shown in FIG. 2.

As shown in FIG. 1 to FIG. 3, a display apparatus 1 includes a front substrate 2 and a rear substrate 4 which are respectively made of a rectangular-shaped glass plate with a thickness of 1 mm to 2 mm, and the substrates are arranged opposite to each other with a gap of about 1.0 mm to 2.0 mm via spacers 8. Then, the front substrate 2 and the rear substrate 4 are joined at the periphery via a rectangular frame-like side wall 6, so that the inside of the joined substrates forms a vacuum envelope 10.

A phosphor screen 12 for displaying an image is formed on the inner surface of the front substrate 2. The phosphor screen 12 has a structure in which R, G and B phosphor layers of red, blue and green, and a light shielding layer 11 are arranged in a matrix form, so as to be covered with a metal back 14. Each of the R, G and B phosphor layers is formed in a substantially rectangular dot shape, and the metal back 14 serving as an anode is formed of a metallic thin film, such as aluminum.

On the inner surface of the rear substrate 4, there are provided a number of surface conduction type electron-emitting devices 16 which emit electrons for making the R, G and B phosphor layers excited and emit light. The electron-emitting devices 16 are arranged in a plurality of rows and a plurality of columns in correspondence with each pixel, and are respectively formed by an electron emitting portion, a pair of element electrodes for applying a voltage to the electron emitting portion (both not shown), and the like. Further, on the inner surface of the rear substrate 4, a number of wirings 18 for applying drive voltages to the respective electron-emitting devices 16 are provided in a matrix form, and the ends of the wirings are lead out to the outside of the vacuum envelope 10.

Note that the front substrates 2 and the rear substrate 4 are degassed and baked in a vacuum atmosphere, and thereafter the substrates are sealed to each other, so as to form the vacuum envelope 10. Prior to the sealing, however, a getter layer (not shown) is formed over the entire inner surface of the front substrate 2 in the vacuum atmosphere, so that the high vacuum can be maintained after the formation of the panel.

When an image is displayed in the display apparatus 1, a voltage is applied between the element electrodes of an arbitrary one of the electron-emitting devices 16 via the wirings 18, to enable an electron beam to be emitted from the electron emitting portion of the electron-emitting device 16. At the same time, the electron beam is accelerated by an anode voltage applied to the phosphor screen 12, so as to be irradiated to the phosphor screen 12. Thereby, a desired phosphor layers R, G and B is excited to emit light, so as to enable the image to be displayed.

First Embodiment

Figure 4:
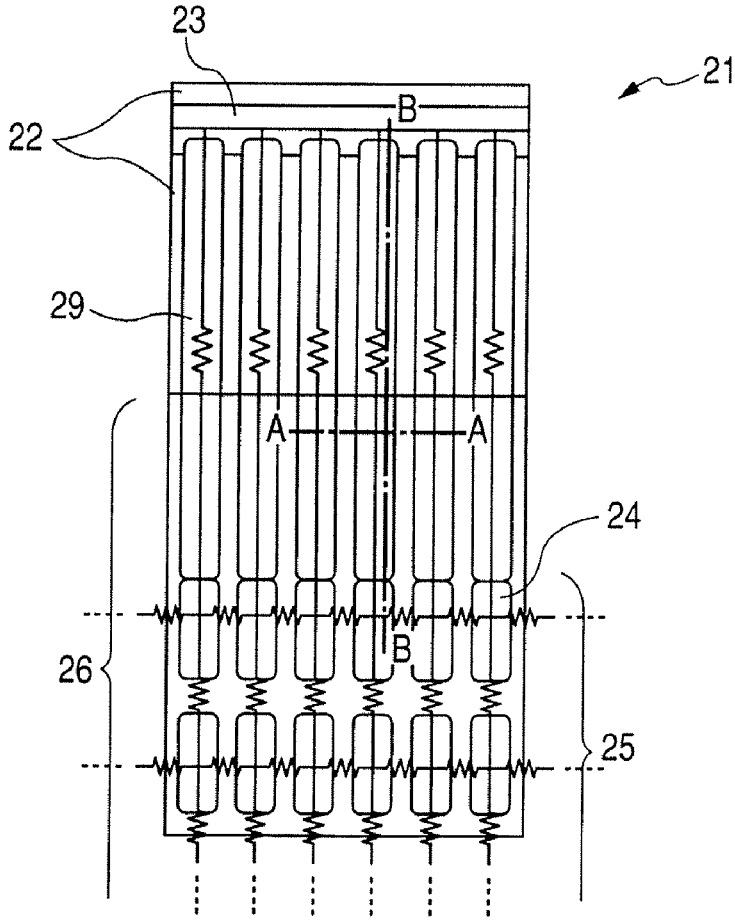
FIG. 4 is a partially enlarged schematic view of a part of a front substrate according to a first embodiment of the present invention.
Figure 5A:
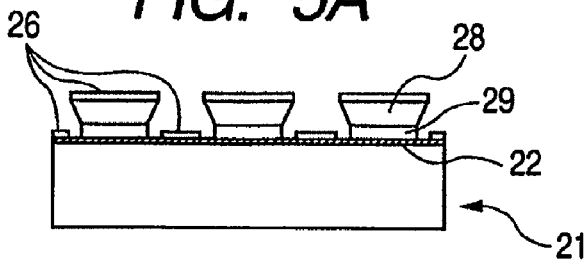
FIG. 5A is a sectional view taken along line A-A in FIG. 4.
Figure 5B:
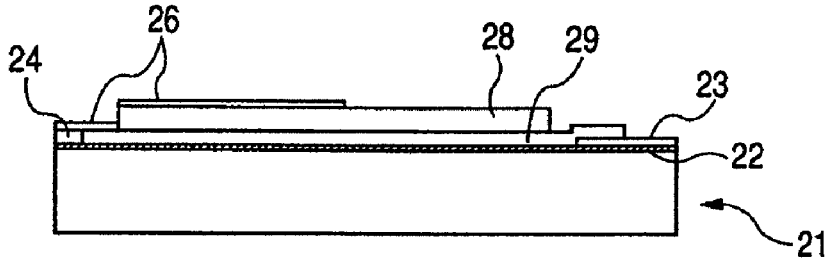
FIG. 5B is a sectional view taken along line B-B in FIG. 4.

FIG. 4 is a partially enlarged schematic view of a part of a front substrate according to a first embodiment of the present invention. FIG. 5A is a sectional view taken along line A-A in FIG. 4. FIG. 5B is a sectional view taken along line B-B in FIG. 4.

As shown in FIGS. 4, 5A and 5B, a light shielding layer 22 made of a black carbon-based material which is an insulating material, is formed on a front substrate 21 made of a glass substrate. Over the light shielding layer 22, there are provided a common electrode 23, and an electroconductive layer 26 which is formed as a metal back layer, and formed into a region larger than an image display area 25 including phosphors 24, so as to sufficiently cover the image display area 25. A getter may be formed by irradiation on the metal back layer. The common electrode 23 is an electrode for supplying a voltage to the electroconductive layer 26 serving as an anode. The voltage is supplied to the common electrode 23 from a power source external to the display apparatus. The metal back functions as the anode. However, when the getter is formed on the metal back and when the getter has electroconductivity, the portion including the metal back and the getter serves as the electroconductive layer 26, so as to function as the anode. A plurality of resistor members 29 which connect the common electrode 23 to the electroconductive layer 26 of the image display area 25 are provided on the light shielding layer 22. In the structure shown in FIGS. 4, 5A and 5B, the electroconductive layer 26 is divided for each pixel of the phosphor 24, and the respective electroconductive layers 26 are connected by $TiO_2$-based resistance material layers in the longitudinal and lateral directions. In FIG. 4, the portion in which the divided electroconductive layers 26 in the image display area are connected by the resistor, is represented by a resistor symbol. The electroconductive layer 26 is divided, and hence is formed by a plurality of electroconductive layers.

Here, the structure of the region outside the image display area 25 is described.

The resistor member 29 which electrically connects the electroconductive layer 26 on the each phosphor 24 of the outermost portion of the image display area 25 to the common electrode 23 has a rib structure. Here, the resistor member 29 having the rib structure is referred to as a lower layer rib 29. An upper layer rib 28, which is an insulating layer and the second layer, is laminated on a part of the lower layer rib 29 which is the resistor member and the first layer. In the region where the resistor member and the insulating layer were laminated to overlap with each other, the electroconductive layer 26 which is the anode, and the lower layer rib 29 which is the resistor member, are separated from each other by the upper layer rib 28 which is the insulating layer. The upper layer rib 28 is formed of an insulating material, and the lower layer rib 29 is formed of a $TiO_2$-based resistance material. Here, there is adopted a structure in which the anode is formed by a plurality of electroconductive layers in the image display area, and in which a voltage is supplied to the respective electroconductive layers from the common electrode via the separate resistor members 29. The respective resistor members 29 are arranged in parallel with each other. The direction (the lateral direction in FIG. 4) in which the respective resistor members 29 are arranged side by side is set as the first direction. As shown in FIG. 5A, the lower layer rib 29 has the same lower surface width as the upper surface width in the cross section in the width direction (the first direction in which the resistor members 29 are arranged). On the other hand, in the width-directional section of the upper layer rib 28, the width of the lower surface (the surface on the side of the resistor member) is the same as the width of the upper surface of the lower layer rib 29, but the width of the upper surface (the surface on the side of anode) is larger than the width of the lower surface. Thus, the upper layer rib 28 has a reversely tapered shape in which the width is increased from the lower surface to the upper surface.

The electroconductive layer 26 is formed by irradiating an electroconductive material to the front substrate 21 before the final stage of the manufacturing process of the front substrate 21, or before the front substrate 21 is sealed with the rear substrate (not shown). At this time, the electroconductive material is not irradiated to the potion on the resistor member 29 which portion is shadowed by the upper layer rib 28, so that the light shielding layer 22 remains to be exposed in the shadow portion. Therefore, the electroconductive layer 26 formed over the mutually adjacent resistor members 29 are divided, so that the mutually adjacent resistor members 29 are electrically insulated from each other.

FIG. 5B shows a state where the electroconductive layer 26 is formed over the resistor member 29 at about half the length of the resistor member 29. As described above, the upper layer rib 28 on the lower layer rib which is the resistor member 29, is formed of the insulating material. The electroconductive layer 26 and the resistor member 29 are brought into direct contact with each other in a part of the region where the electroconductive layer 26 and the resistor member 29 overlap with each other. Thereby the voltage supplied from the common electrode 23 is supplied to the electroconductive layer 26 via the resistor member 29. On the other hand, in the other part of the region where the electroconductive layer 26 and the resistor member 29 overlap with each other, the portion between the resistor member 29 and the electroconductive layer 26 is insulated by the upper layer rib 28 which is the insulating layer. Thus, the electroconductive layer 26 is insulated from the lower layer rib 29 by the upper layer rib 28. Thereby, the resistance value between the electroconductive layer 26 and the common electrode 23 is kept constant irrespective of the size of forming range of the electroconductive layer 26 formed on the upper layer rib 28. In this way, according to the structure of the present embodiment, the resistance value between the common electrode 23 and the electroconductive layer 26 can be kept constant irrespective of the size of forming range of the electroconductive layer 26 formed over the resistor member 29. Note that in FIG. 4, the upper layer rib which is the insulating layer is omitted for clarity of illustration.

Note that here, there is shown an embodiment in which the anode is formed by a plurality of electroconductive layers in the image display area, and a voltage is supplied to each electroconductive layer from the common electrode via each different resistor member, but the present invention is not limited to this. That is, it is also possible to connect the anode and the common electrode by using only one resistor member.

Further, there is shown an example in which the resistor member is provided beforehand, and then the anode is formed. However, it is also possible to adopt a structure in which the insulating layer is formed after the anode is formed, and thereafter the resistor member is provided. Also in this case, the resistance between the anode and the common electrode can be suppressed from being changed in dependence upon the size of the forming region of the anode, by separating the anode from the resistor member by the insulating layer.

Second Embodiment

Figure 6A:
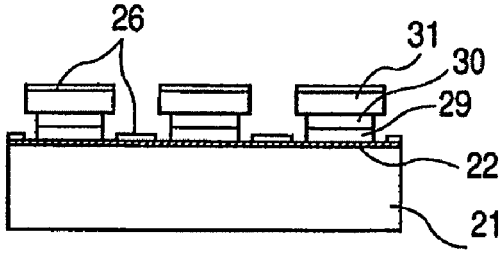
FIGS. 6A and 6B show a second embodiment according to the present invention.
Figure 6B:
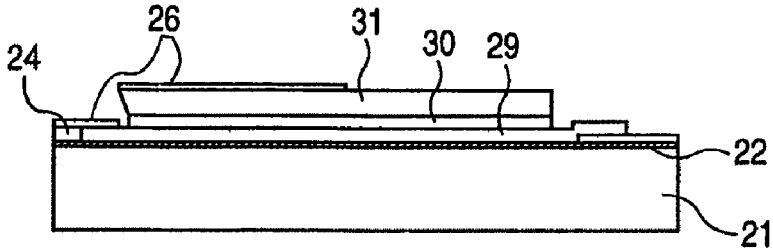

FIGS. 6A and 6B are figures showing a second embodiment according to the present invention. FIG. 6A is a sectional view of a portion corresponding to the sectional view taken along line A-A in FIG. 4. FIG. 6B is a sectional view of a portion corresponding to the sectional view taken along line B-B in FIG. 4.

The resistor member 29 according to the present embodiment is formed by the lower layer rib 29 as the first layer formed on the light shielding layer 22. Over the lower layer rib 29, there are provided an uppermost layer rib 31 as the second layer, and an upper layer rib 30 as the third layer formed between the lower layer rib 29 and the uppermost layer rib 31. The lower layer rib 29 is a resistor member made of a resistance material. The upper layer rib 30 is an insulating layer made of an insulating material. Further, the uppermost layer rib 31 which is another layer according to the present embodiment, is made of an insulating material, but the material to form the uppermost layer rib 31 is not limited to the insulating material.

As shown in FIG. 6A, in the width-directional section of the resistor member 29, the upper layer rib 30 and the lower layer rib 29 have the same width. In the uppermost layer rib 31 has a width larger than the width of the upper layer rib 30 and of the lower layer rib 29. In the example shown in FIG. 6A, the uppermost layer rib 31 has the lower and upper surfaces of the same width. However, as in the upper layer rib 28 shown in FIG. 5A, the uppermost layer rib 31 may have the reversely tapered shape in which the width is increased from the lower surface (the surface on the side of the resistor member) to the upper surface (the surface on the side of the anode).

Also, according to the present embodiment, the conductive material is not irradiated to the shadow portion of uppermost layer rib 31, and hence the light shielding layer 22 remains to be exposed in the shadow portion. Therefore, the electroconductive layer 26 formed over the mutually adjacent resistor members 29 is divided, so that the adjacent resistor members 29 are electrically insulated from each other. Further, the portion between the resistor member 29 and the electroconductive layer 26 is separated by the upper layer rib 30 which is the insulating layer. The resistance value between the common electrode 23 and the electroconductive layer 26 can be kept constant irrespective of the size of the forming range of the electroconductive layer 26 formed over the resistor member 29.

Third Embodiment

Figure 7:
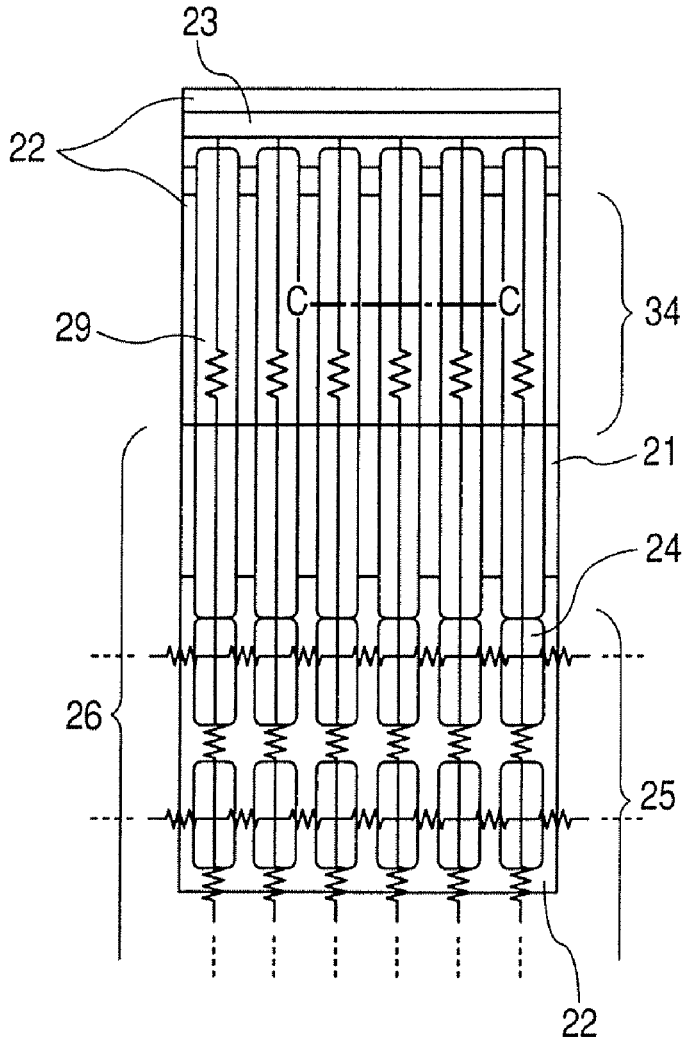
FIG. 7 is a partially enlarged schematic view of a part of a front substrate according to a third embodiment of the present invention.
Figure 8:
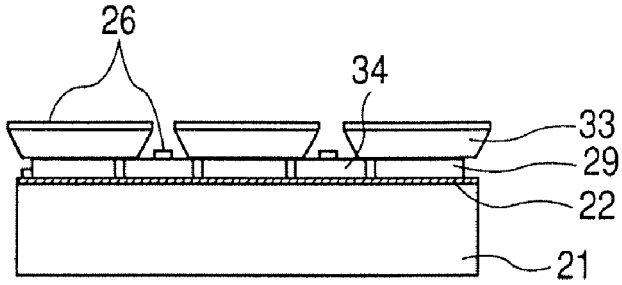
FIG. 8 is a sectional view taken along line C-C in FIG. 7.

FIG. 7 is a partially enlarged schematic view of a part of a front substrate according to a third embodiment of the present invention. FIG. 8 is a sectional view taken along line C-C in FIG. 7.

Also in the present embodiment, similarly to the structure shown in FIGS. 4, 5A and 5B, the light shielding layer 22 made of a black carbon-based material as an insulating material is formed on the front substrate 21 made of a glass substrate. Over the light shielding layer 22, there are provided the common electrode 23, and the electroconductive layer 26 which includes a metal back layer and/or a getter layer, and which is formed in a region larger than the image display area 25 including the phosphor 24, so as to sufficiently cover the image display area 25. The resistor member 29 which connects the common electrode 23 and the electroconductive layer 26 in the image display area 25 is formed on the light shielding layer 22. The electroconductive layer 26 is divided for each pixel of the phosphor 24, and the respective electroconductive layers 26 are connected by the $TiO_2$-based resistance material layer in the longitudinal and lateral directions.

The resistor member 29 which electrically connects the electroconductive layer 26 on the each phosphor 24 of the outermost portion in the image display area 25, to the common electrode 23 has a rib structure. Here, the resistor member 29 is the lower layer rib 29. The upper layer rib 33 as the second layer is laminated on the lower layer rib 29 as the first layer. The respective resistor members 29 are arranged in parallel with each other. The upper layer rib 33 is formed of an insulating material, and the lower layer rib 29 is formed of the resistance material. As shown in FIG. 8, in the width-directional section of the lower layer rib 29, the width of the lower layer is the same as the width of the upper layer. On the other hand, in the width-directional section of the upper layer rib 33, the width of the lower surface of the upper layer rib 33 is larger than the width of the upper surface of the lower layer rib 29. Further, the width of the upper surface of the upper layer rib 33 is larger than the width of the lower surface thereof. Thus, the upper layer rib 33 has the reversely tapered shape in which the width is increased from the lower surface to the upper surface.

A rib 34 extending in parallel with the resistor member 29 is formed between the lower layer ribs 29. The rib 34 is made of an insulating material and forms an insulation layer having substantially the same height as the lower layer rib 29. As shown in FIG. 8, the upper layer rib 33 has a structure in which the width of the lower surface of the upper layer rib 33 is larger than the width of the upper surface of the lower layer rib 29, and in which both the width-direction ends of the upper layer rib 33, which is the layer to overlap with the resistor member, is supported by riding on the rib 34. Note that in FIG. 7, the upper layer rib 33 is omitted for clarity of illustration.

According to the structure of the present embodiment, the mutually adjacent resistor members 29 are electrically insulated from each other, similarly to the respective embodiments as described above. Further, the resistance value between the electroconductive layer 26 and the common electrode can be kept constant irrespective of the size of the forming range of the electroconductive layer 26 formed over the resistor member 29. Further, according to the present embodiment, the structure in which both the width-direction ends of the upper layer rib 33 ride on the rib 34, is adopted so that the width of the lower surface of the upper layer rib 33 can be stably made wider than the width of the lower layer rib 32. Further, the width of the lower surface of the upper layer rib 33 is made large, so that the difference in the width between the lower and upper surfaces of the upper layer rib 33 can be reduced as compared with the structure shown in FIGS. 5A and 5B. Thereby, the inclination of the reversely tapered side surface of the upper layer rib 33 can be reduced, so that the upper layer rib 33 is hardly deformed at both the width-direction ends of the upper layer rib 33.

EXAMPLE

In the following, the embodiments according to the present invention will be described by means of specific examples.

Figure 9:
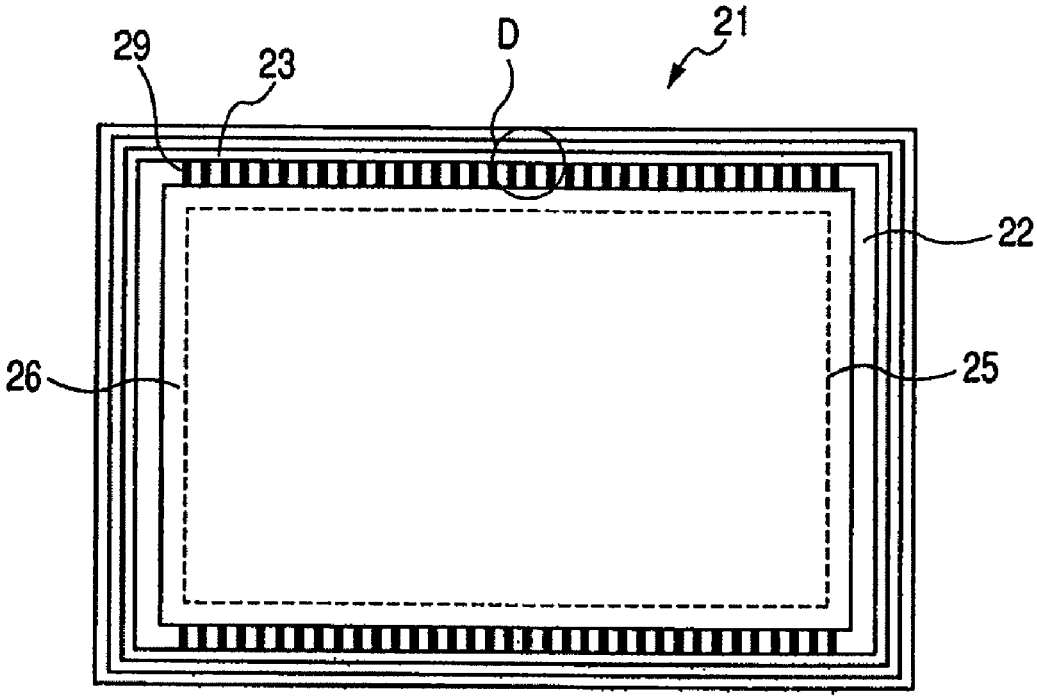
FIG. 9 is a figure showing a middle stage of manufacturing a front substrate of a display apparatus according to an example of the present invention.
Figure 10:
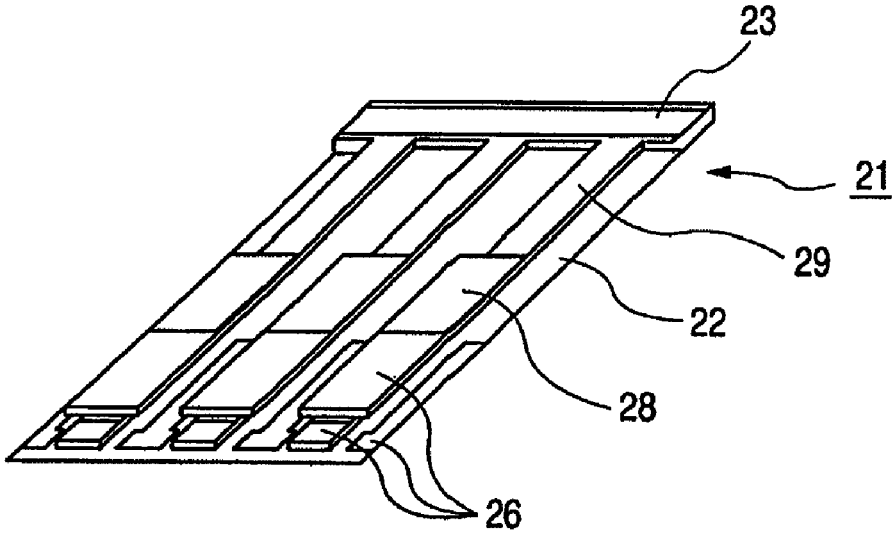
FIG. 10 is a three-dimensionally enlarged view of the part surrounded by the circle D shown in FIG. 9.

FIG. 9 is a figure showing a middle stage of manufacturing a front substrate of an SED according to an embodiment of the present invention. FIG. 10 is a three-dimensionally enlarged view of the portion surrounded by the circle D shown in FIG. 9.

The light shielding layer 21 is formed as the lowermost layer on substantially the entire surface of the front substrate 21. The light shielding layer 21 is formed of a black carbon-based material having sheet resistance of $1\times10^{10}$ Ω/□. The electroconductive layer (metal back) 26 divided for each pixel is formed in a region over the light shielding layer 21, which region is larger by about several millimeters than the four sides of the image display area 25. The common electrode 23 made of Ag is also formed on the light shielding layer 21 so as to surround the periphery of the electroconductive layer 26. Further, on the light shielding layer 21, there are formed the plurality of resistor members 29 which electrically connect the respective outermost electroconductive layers 26 in the image display area 25 to the common electrode 23, and which are arranged in parallel with each other. The connecting resistor member 29 is formed of a $TiO_2$-based material having sheet resistance of $2\times10^5$ Ω/□. Note that the resistor member 29 is integrally formed with the support member of the common electrode 23. Outside the image display area 25, the insulation layer 28 made of a material having sheet resistance of $1\times10^8$ Ω/□ is formed on the resistor member 29.

The resistor member 29 has a shape in which the plurality of resistor members are extended in the form of strips. The each resistor member has a width of 55 mm, a length of 10 mm, and a thickness of several tens μm. The insulation layer 28 formed on the each resistor member has an upper surface width of 65 μm, a lower surface width of 60 μm, a length of 5 mm, and a thickness of several tens μm.

In the present embodiment, the electroconductive layer 26 is formed such that the outer edge of the forming range of the electroconductive layer 26 is included within the range in which the insulation layer 28 is formed. The electroconductive layer 26 formed on the insulation layer 28 of the mutually adjacent resistor members 29 is divided, and hence the mutually adjacent resistor members 29 are electrically insulated from each other. The resistance value between the common electrode 23 and the electroconductive layer 26 is kept constant, irrespective of the size of the forming range of the electroconductive layer 26, as long as the outer edge of the forming range of the electroconductive layer 26 is included within the range in which the insulation layer 28 is formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2006-347643, filed Dec. 25, 2006, and No. 2007-324838, filed Dec. 17, 2007, which are hereby incorporated by reference herein in their entirety.

What is claimed is:

1. A flat panel type display apparatus comprising:

a front substrate having a plurality of phosphor layers, an anode including a plurality of electroconductive layers which covers a phosphor layer respectively, an electrode for applying a voltage to the anode, and a resistor member connecting the anode to the electrode via a part of the plurality of electroconductive layers; and a rear substrate having a plurality of electron-emitting devices corresponding to the plurality of phosphor layers, wherein a part of the resistor member is covered with an insulating layer, the anode and the resistor member are connected such that the part of the plurality of electroconductive layers continuously covers another part of the resistor member not covered with the insulating layer and the phosphor layer, the anode includes a further electroconductive layer different from the plurality of electroconductive layers, the further electroconductive layer covers a part of the insulating layer, and the plurality of electroconductive layers and the further electroconductive layer are divided by the insulating layer.

2. The flat panel type display apparatus according to claim 1, wherein a width of the insulating layer at a side of the resistor member is smaller than a width of the insulating layer at a side of the further electroconductive layer.

3. The flat panel type display apparatus according to claim 1, wherein the resistor member comprises a plurality of resistor members, the anode and the electrode are connected in parallel by the plurality of resistor members, each of the plurality of resistor members is connected to a corresponding electroconductive layer of the plurality of electroconductive layers, the corresponding electroconductive layer being different for each resistor member.

* * * * *